US009077106B2

(12) United States Patent
Suzuki

(10) Patent No.: US 9,077,106 B2
(45) **Date of Patent: *Jul. 7, 2015**

(54) CONNECTOR WITH INTERMEDIATE HOUSING BETWEEN FIRST AND SECOND IDENTICAL INNER HOUSINGS AND FIRST AND SECOND DIFFERENTLY SHAPED OUTER HOUSINGS

(71) Applicant: Sumitomo Wiring Systems, Ltd., Yokkaichi, Mie (JP)

(72) Inventor: Masakazu Suzuki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/066,086

(22) Filed: Oct. 29, 2013

(65) Prior Publication Data

US 2014/0120758 A1 May 1, 2014

(30) Foreign Application Priority Data

Oct. 29, 2012 (JP) ..... 2012-237617

(51) Int. Cl.

| | |
|---|---|
| ***H01R 13/62*** | (2006.01) |
| ***H01R 13/627*** | (2006.01) |
| ***H01R 13/629*** | (2006.01) |
| *H01R 31/06* | (2006.01) |

(52) U.S. Cl.

CPC ..... *H01R 13/6272* (2013.01); *H01R 13/62938* (2013.01); *H01R 31/06* (2013.01)

(58) Field of Classification Search

CPC ..... H01R 13/62938; H01R 13/6275; H01R 31/06; H01R 31/02; H01R 31/00; H01R 9/2458; H05K 7/026

USPC ..... 439/76.2, 157, 345, 638, 721–724, 949

See application file for complete search history.

(56) References Cited

U.S. PATENT DOCUMENTS

| | | | | |
|---|---|---|---|---|
| 5,645,455 | A * | 7/1997 | Seki | 439/723 |
| 5,908,322 | A * | 6/1999 | Seki | 439/212 |
| 6,623,309 | B2 * | 9/2003 | Sakurai et al. | 439/701 |
| 6,739,920 | B2 * | 5/2004 | Fujii et al. | 439/723 |
| 6,875,053 | B2 * | 4/2005 | Fujii et al. | 439/567 |
| 6,878,017 | B2 * | 4/2005 | Sakurai et al. | 439/723 |
| 7,118,423 | B2 * | 10/2006 | Kobayashi et al. | 439/682 |
| 7,287,993 | B2 * | 10/2007 | Fujii et al. | 439/157 |
| 8,690,607 | B2 * | 4/2014 | Tsukamoto et al. | 439/620.09 |
| 2014/0120759 | A1 * | 5/2014 | Suzuki | 439/345 |

FOREIGN PATENT DOCUMENTS

| | | |
|---|---|---|
| JP | 2007-227404 | 9/2007 |

* cited by examiner

*Primary Examiner* — Thanh Tam Le

(74) *Attorney, Agent, or Firm* — Gerald E. Hespos; Michael J. Porco; Matthew T. Hespos

(57) ABSTRACT

A connector includes an intermediate housing (10) with a first fitting recess (12) and a second fitting recess (13), a first inner housing (30A) to be fitted into the first fitting recess, a first outer housing (50) separate from the first inner housing (30A) and to be externally fitted onto the first fitting recess (12), a second inner housing (30B) to be fitted into the second fitting recess (13), and a second outer housing (70) separate from the second inner housing (30B) and to be externally fitted onto the second fitting recess (13). The first and second outer housings (50, 70) are shaped differently from each other and the first and second inner housings (30A, 30B) are identically shaped.

8 Claims, 14 Drawing Sheets

CONNECTOR WITH INTERMEDIATE HOUSING BETWEEN FIRST AND SECOND IDENTICAL INNER HOUSINGS AND FIRST AND SECOND DIFFERENTLY SHAPED OUTER HOUSINGS

BACKGROUND

1. Field of the Invention

The invention relates to a connector.

2. Description of the Related Art

Japanese Unexamined Patent Publication No. 2007-227404 discloses a connector with a partition wall through which an intermediate terminal penetrates to be mounted, an intermediate housing which is partitioned into a first fitting recess and a second fitting recess by the partition wall as a boundary, a first housing which is fitted into the first fitting recess and in which a first terminal fitting connectable to a first end portion of the intermediate terminal is mounted and a second housing which is fitted into the second fitting recess and in which a second terminal fitting connectable with a second end portion of the intermediate terminal is mounted. The first and second end portions of the intermediate terminal are arranged to project into the first and second fitting recesses. The first housing is composed of a single housing, and a second housing is composed of a plurality of sub-housings.

In the above case, since the first and second housings are shaped differently from each other, parts cost increases since parts cannot be shared between the first and second housings. On the other hand, if the second housing is composed of a single housing without being divided into a plurality of sub-housings, the first and second housings can be identically shaped, which can suppress a cost increase by sharing parts.

However, for a certain reason such as an operating condition at the time of a connecting operation, for example, the first housing may need to be fitted into the first fitting recess utilizing a force multiplying mechanism such as a lever, but it may be sufficient to manually fit the second housing into the second fitting recess without necessitating a force multiplying mechanism. As a result, the first housing including the lever or the like and the second housing not including the lever or the like have different shapes, which leads to a problem that parts cannot be shared.

The present invention was completed in view of the above situation and aims to reduce cost.

SUMMARY OF THE INVENTION

According to one aspect of the invention, there is provided a connector, comprising: an intermediate housing including a first fitting recess and a second fitting recess; a first inner housing which is to be at least partly fitted into the first fitting recess and into which at least one first terminal fitting is to be mounted; a first outer housing which is separate from the first inner housing, fitted to the first fitting recess, coupled to the first inner housing and held in a state fitted on the first fitting recess by a first holding means; a second inner housing which is to be at least partly fitted into the second fitting recess and into which at least one second terminal fitting is to be mounted; and a second outer housing which is separate from the second inner housing, fitted to the second fitting recess, coupled to the second inner housing and held in a state fitted on the second fitting recess by a second holding means different from the first holding means; wherein: the first and second outer housings are shaped differently from each other at least due to a difference between the first and second holding means; and the first and second inner housings are identically shaped.

According to a particular embodiment, the intermediate housing includes at least one partition wall through which at least one intermediate terminal penetrates to be mounted, wherein a first end portion and a second end portion of the intermediate terminal are located at opposite sides of the partition wall in the first fitting recess and the second fitting recess to be connected to the first terminal fitting and the second terminal fitting, respectively.

Particularly, the partition wall comprises one or more projecting plate portions at least partly projecting into the second fitting recess particularly substantially in a plurality of different vertical levels.

Further particularly, the first outer housing is externally fitted onto the first fitting recess, coupled to the first inner housing to at least partly surround the first inner housing and/or wherein the second outer housing is externally fitted onto the second fitting recess, coupled to the second inner housing to at least partly surround the second inner housing.

According to a further particular embodiment of the invention, there is provided a connector, comprising an intermediate housing including a partition wall through which an intermediate terminal penetrates to be mounted and a first fitting recess and a second fitting recess in which a first end portion and a second end portion of the intermediate terminal are located at opposite sides of the partition wall; a first inner housing which is fitted into the first fitting recess and into which a first terminal fitting connectable to the first end portion of the intermediate terminal is mounted; a first outer housing which is separate from the first inner housing, externally fitted onto the first fitting recess, coupled to the first inner housing to surround the first inner housing and held in a state fitted on the first fitting recess by a first holding means; a second inner housing which is fitted into the second fitting recess and into which a second terminal fitting connectable to the second end portion of the intermediate terminal is mounted; and a second outer housing which is separate from the second inner housing, externally fitted onto the second fitting recess, coupled to the second inner housing to surround the second inner housing and held in a state fitted on the second fitting recess by a second holding means different from the first holding means; wherein the first and second outer housings are shaped differently from each other due to a difference between the first and second holding means; and the first and second inner housings are identically shaped.

Further particularly, the first holding means comprises a lock arm for resiliently locking a lock portion provided on or at the first fitting recess at the time of proper connection.

Further particularly, the second holding means comprises a lever which displays a cam action between the lever and the intermediate housing to proceed with a connecting operation by being displaced relative to the second fitting recess in a state where the second holding means is engaged with a cam portion provided on the second fitting recess.

Further particularly, the first holding means is composed of a lock arm for resiliently locking a lock portion provided on the first fitting recess at the time of proper connection; and the second holding means is composed of a lever which displays a cam action between the lever and the intermediate housing to proceed with a connecting operation by being displaced relative to the second fitting recess in a state where the second holding means is engaged with a cam portion provided on the second fitting recess. Thus, a connecting operation can proceed with a small operating force by a cam action of the lever on the side of the second fitting recess. In this case, if the first holding means is also composed of a lever to share parts, cost increases. However, since the lever needs not be provided on the side of the first fitting recess that can be manually connected according to this configuration, a cost increase can be suppressed to a minimum necessary level.

Further particularly, one or more releasing ribs are formed on the second fitting recess so as to function to release a locking state of the second holding means.

Further, one or more shake preventing protrusions are formed on the second fitting recess so as to come into contact with the second outer housing particularly externally fitted on the second fitting recess.

These and other objects, features and advantages of the invention will become more apparent upon reading the following detailed description of preferred embodiments and accompanying drawings.

DETAILED DESCRIPTION OF THE PREFERRED EMBODIMENTS

Figure 2:
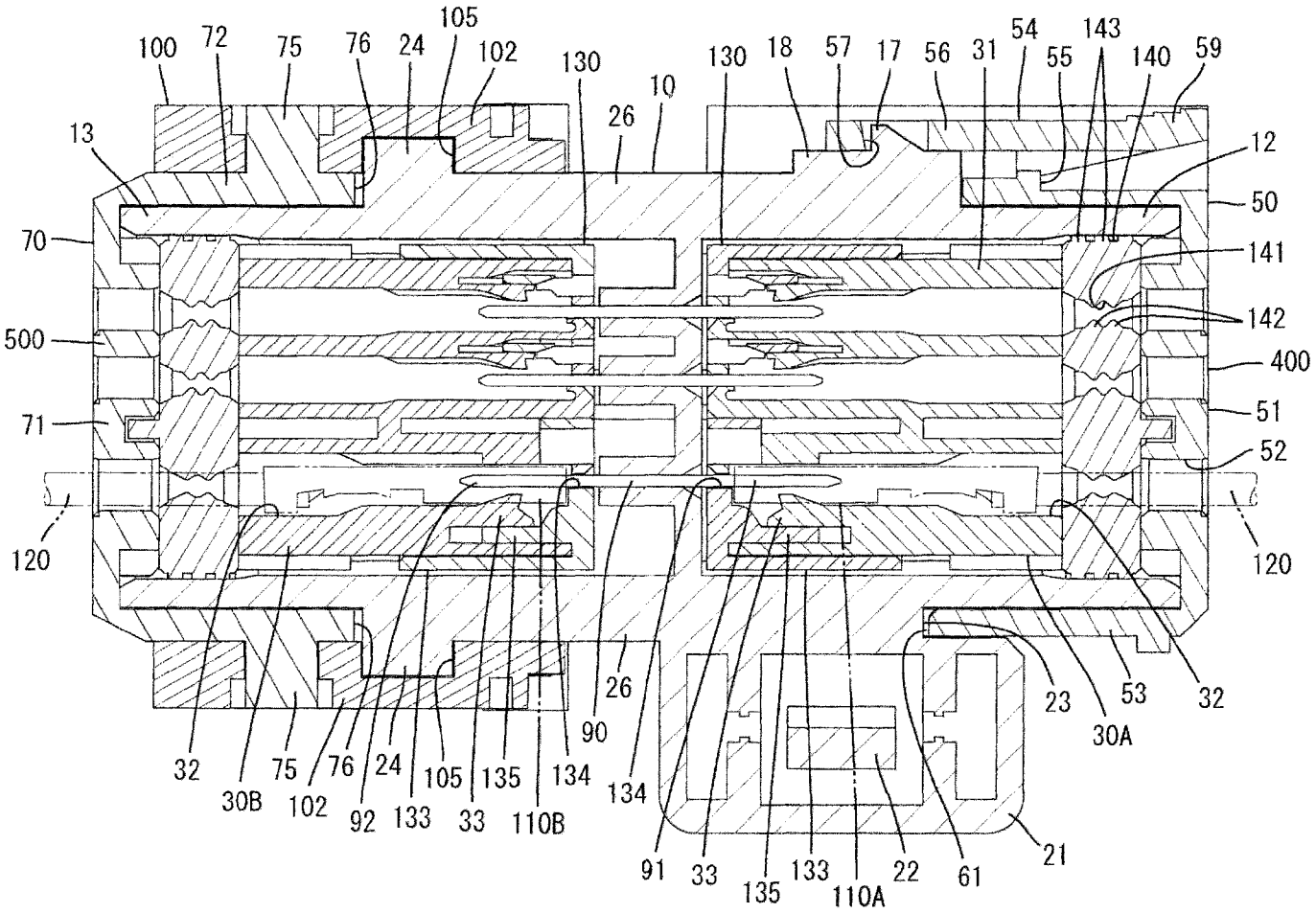
FIG. 2 is a section along A-A of FIG. 1.

A connector according to the invention is a joint connector and particularly includes an intermediate housing 10, a first inner housing 30A, a first outer housing 50, a second inner housing 30B and a second outer housing 70. Note that, in the following description, a right side of FIG. 2 is a front side concerning forward and backward directions and a vertical direction is based on FIG. 2.

Figure 5:
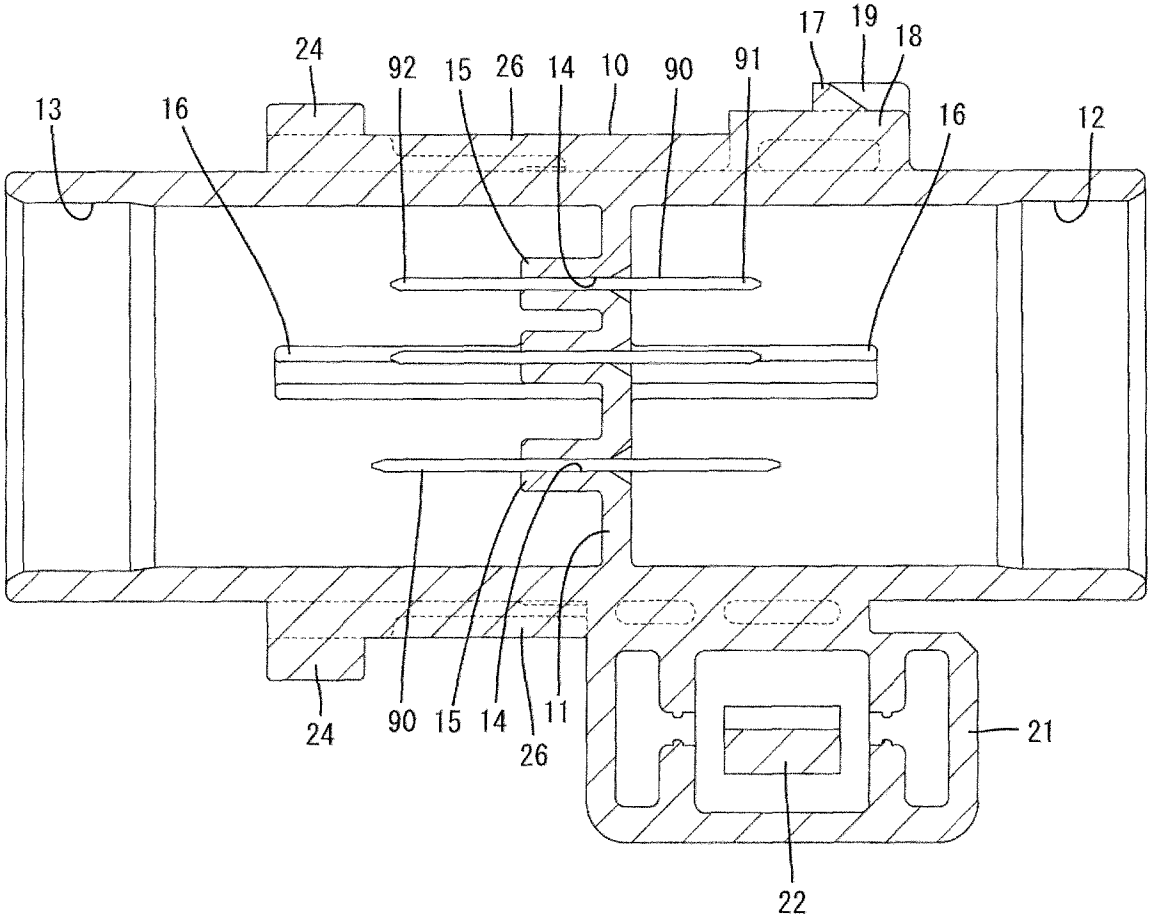
FIG. 5 is a section of an intermediate housing.

The intermediate housing 10 is made e.g. of synthetic resin and, as shown in FIG. 5, includes a partition wall 11 particularly substantially in the form of a vertical wall, and (particularly substantially tubular) first and second fitting recesses 12, 13 arranged at lateral sides (particularly substantially opposite front and rear sides) of the partition wall 11. The first and second fitting recesses 12, 13 particularly substantially are open in opposite directions. Specifically, the first fitting recess 12 is open forward and the second fitting recess 13 is open backward. As shown in FIG. 2, the first inner housing 30A at least partly is fittable into the first fitting recess 12 and the first outer housing 50 at least partly is fittable onto or to the first fitting recess 12. Further, the second inner housing 30B at least partly is fittable into the second fitting recess 13 and the second outer housing 70 at least partly is fittable onto or to the second fitting recess 13.

As shown in FIG. 5, the partition wall 11 is formed with one or more, particularly a plurality of mounting holes 14. The partition wall 11 is also formed with one or more, particularly a plurality of projecting plate portions 15 at least partly projecting into the second fitting recess 13 particularly substantially in a plurality of different vertical levels. Each mounting hole 14 penetrates from the partition wall 11 to the corresponding projecting plate portion 15. An intermediate terminal 90 (mating conductor) is inserted (particularly press-fitted) into each mounting hole 14 to be mounted particularly from the side of the first fitting recess 12.

As shown in FIG. 5, the intermediate terminal 90 particularly substantially is a busbar long and narrow in forward and backward directions, a front end part thereof serves as a first end portion 91 located in or at the first fitting recess 12 and a rear end part thereof serves as a second end portion 92 located in or at the second fitting recess 13.

Further, the partition wall 11 is formed with one or more guide ribs 16 substantially extending in forward and backward directions and/or at least partly projecting into the first and/or second fitting recesses 12, 13. When the first and second inner housings 30A, 30B are fitted into the first and second fitting recesses 12, 13, fitting operations are guided by the guide rib(s) 16.

Figure 6:
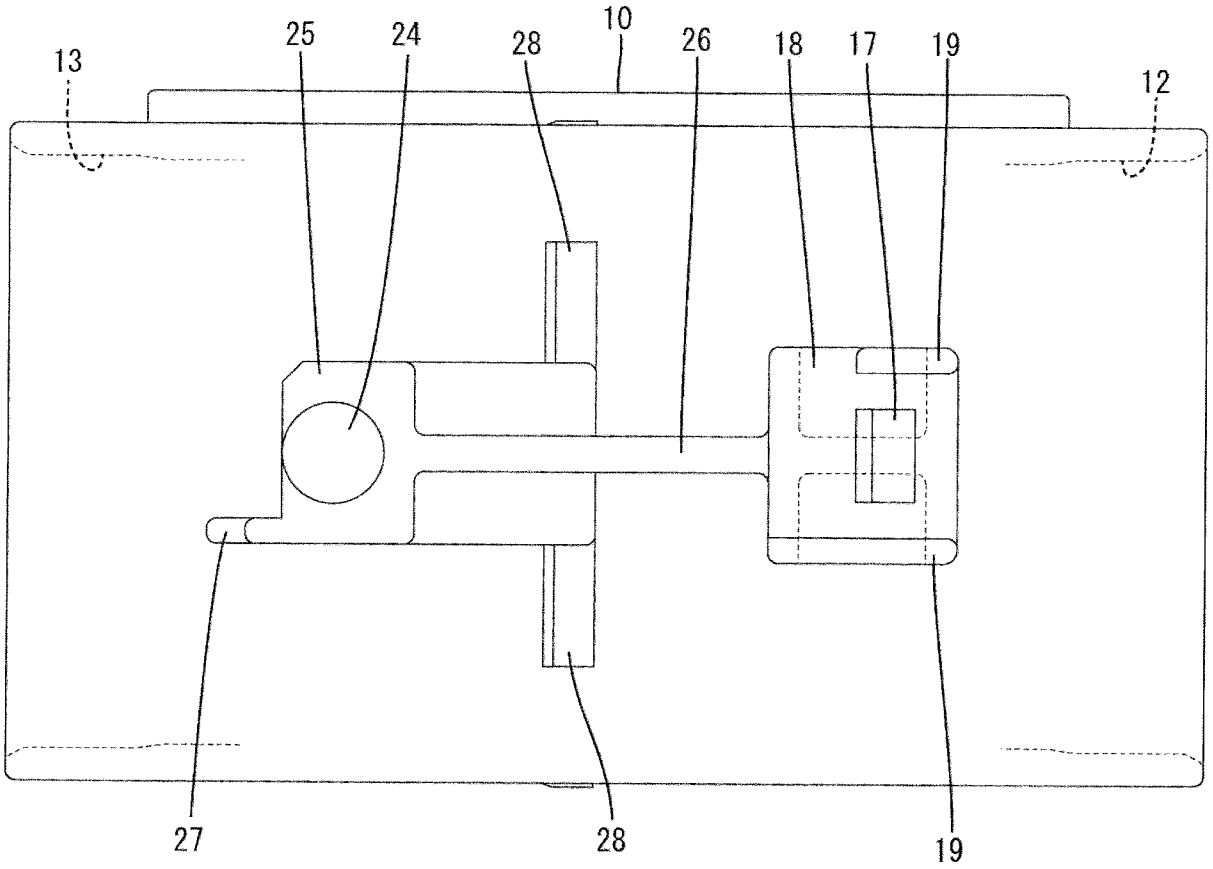
FIG. 6 is a plan view of the intermediate housing.

As shown in FIGS. 5 and 6, at least one lock portion 17 projects on the outer or lateral (upper) surface of the first fitting recess 12. The lock portion 17 particularly is arranged at a raised position via a first base portion 18 in the form of a substantially flat base. One or more, particularly a pair of protection walls 19 are formed adjacent to the lock portion, particularly at substantially opposite sides of the lock portion 17 on opposite widthwise ends of the first base portion 18. The first outer housing 50 is held in a state fitted on the first fitting recess 12 by the lock portion 17.

Figure 7:
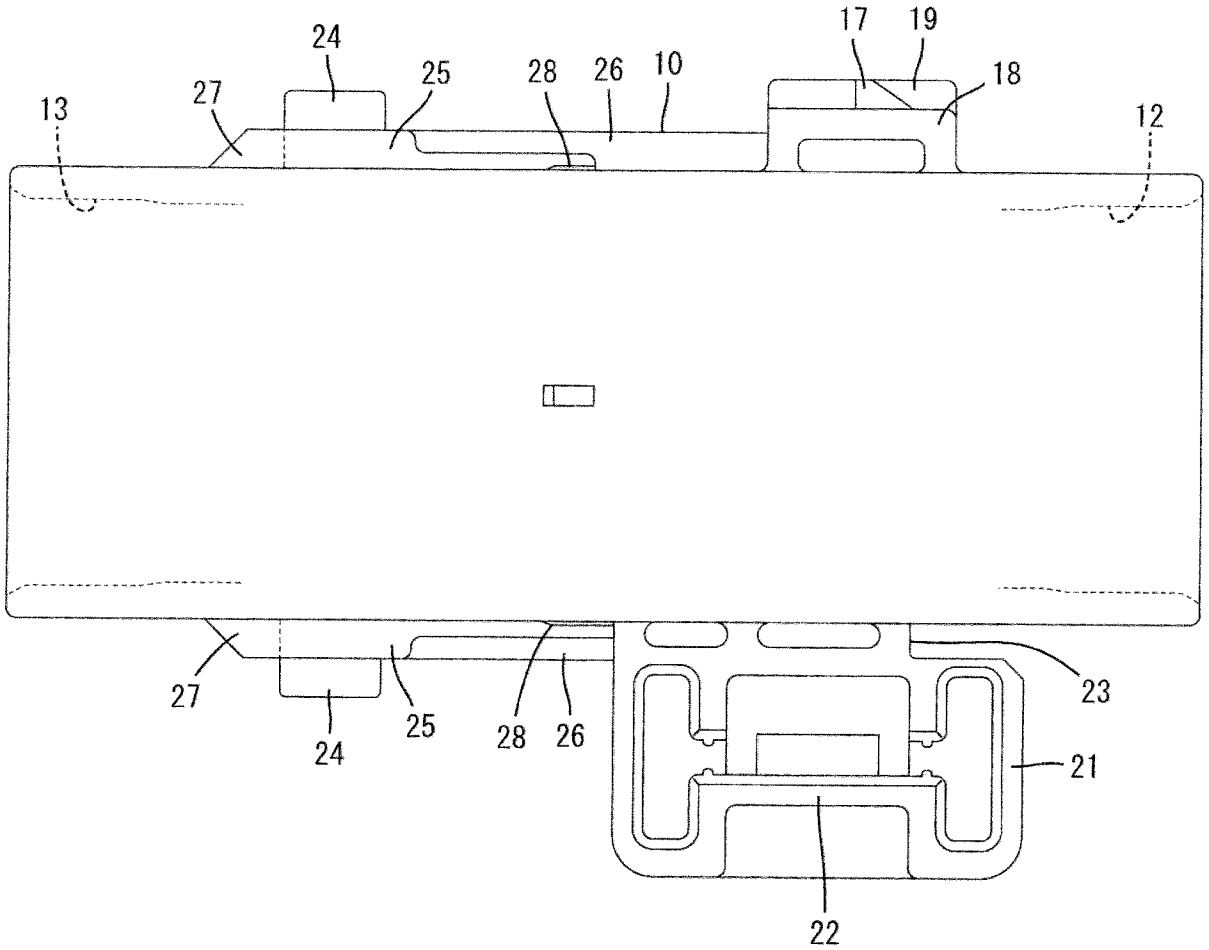
FIG. 7 is a side view of the intermediate housing.

As shown in FIG. 7, a mounting portion 21 projects on the outer or lateral (lower) surface of the first fitting recess 12. The mounting portion 21 particularly substantially is in the form of a box which is open on opposite widthwise sides, and at least one resiliently deformable lock piece 22 is formed thereat or therein. An unillustrated bracket fixed to an unillustrated mounting target is to be slidably at least partly inserted from one widthwise side and the inserted bracket is resiliently locked by the lock piece(s) 22. In this way, the intermediate housing 10 is mounted on the mounting target via the bracket. Note that an upper end part of the mounting portion 21 particularly is constricted and includes a slit-like entrance recess 23 which substantially is open forward. As shown in FIG. 2, a lower part of an outer peripheral wall 53 of the first outer housing 50 to be described later is at least partly insertable into the entrance recess 23.

As shown in FIG. 7, one or more, particularly a pair of cam portions 24 project on the lateral (upper and/or lower) surface(s) of the second fitting recess 13. The cam portion(s) 24 particularly has/have a substantially cylindrical shape and function(s) to proceed with or assist a connecting operation of the second outer housing 70 with a small connecting force by being engaged with a movable member such as a lever 100 (second holding means) to be described later mounted on the second outer housing 70. Further, the (particularly each) cam portion 24 is arranged at a raised position via a second base portion 25 particularly substantially in the form of a flat base in a manner as described above. As shown in FIG. 6, the first base portion 18 and the second base portion 25 are coupled to each other via at least one coupling rib 26 extending in forward and backward directions. As shown in FIG. 7, another coupling rib 26 is also formed on the outer or lateral (lower) surface of the intermediate housing 10 to couple the second base portion 25 and the mounting portion 21. The coupling rib(s) 26 function(s) to suppress warping when the intermediate housing 10 is molded particularly by straddling over the first and second fitting recesses 12, 13.

As shown in FIGS. 6 and 7, one or more releasing ribs 27 substantially extending backward from (particularly the rear ends of) the second base portions 25 are formed on the lateral (upper and/or lower) surface(s) of the second fitting recess 13. The releasing rib(s) 27 function(s) to release a locking state of later-described resilient locking portion(s) 106 of the lever 100 by interfering with the resilient locking portion(s) 106. Further, one or more shake preventing protrusions 28 (particularly substantially extending in a width direction) are formed on the lateral (upper and/or lower) surface(s) of (particularly a front end part of) the second fitting recess 13. The second outer housing 70 externally fitted on the second fitting recess 13 comes into contact with the shake preventing protrusion(s) 28, thereby suppressing shaking movement of the second outer housing 70 relative to the second fitting recess 13.

The first inner housing 30A is likewise made e.g. of synthetic resin and particularly identically shaped to the second inner housing 30B. Specifically, the first and second inner housings 30A, 30B are identically shaped and sized, have no shape difference between them and can be commonly or exchangeably used. Thus, although the shape of the first inner housing 30A is described below, it is also the shape of the second inner housing 30B. Therefore, common parts of the first and second inner housings 30A, 30B are denoted by the same terms and reference signs and the shape of the second inner housing 30B is not described. Of course, since the first and second inner housings 30A, 30B are arranged in opposite directions, they have opposite concepts of forward and backward directions below.

Figure 3:
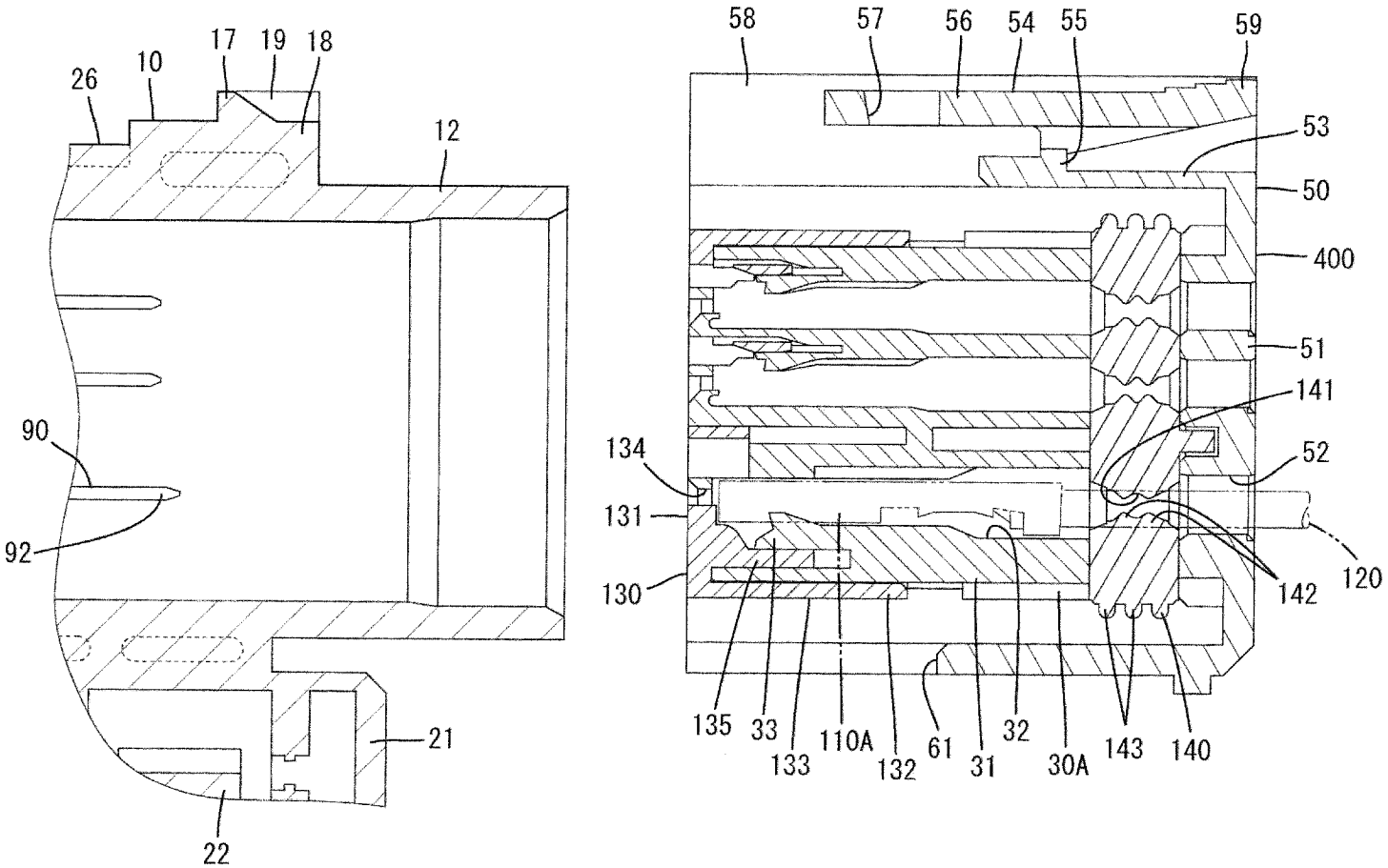
FIG. 3 is an exploded section of a first housing and a first fitting recess.
Figure 8:
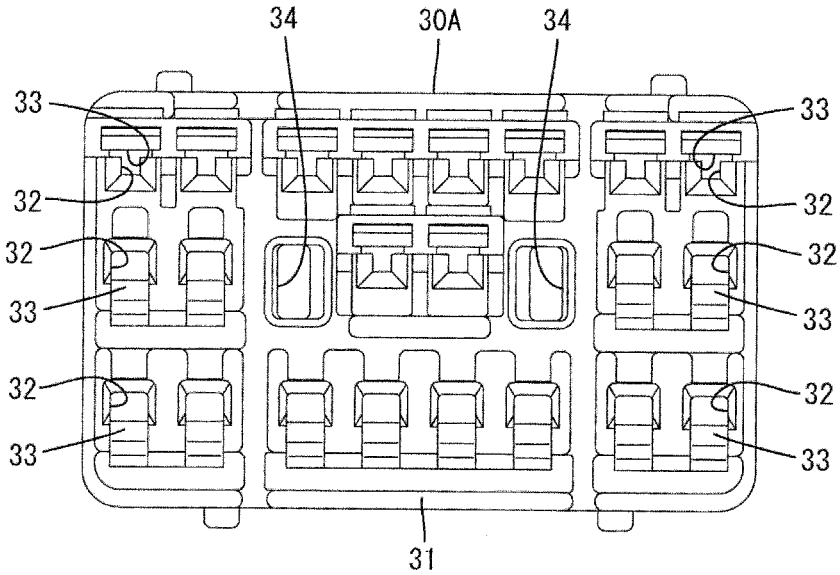
FIG. 8 is a front view of a first inner housing.
Figure 9:
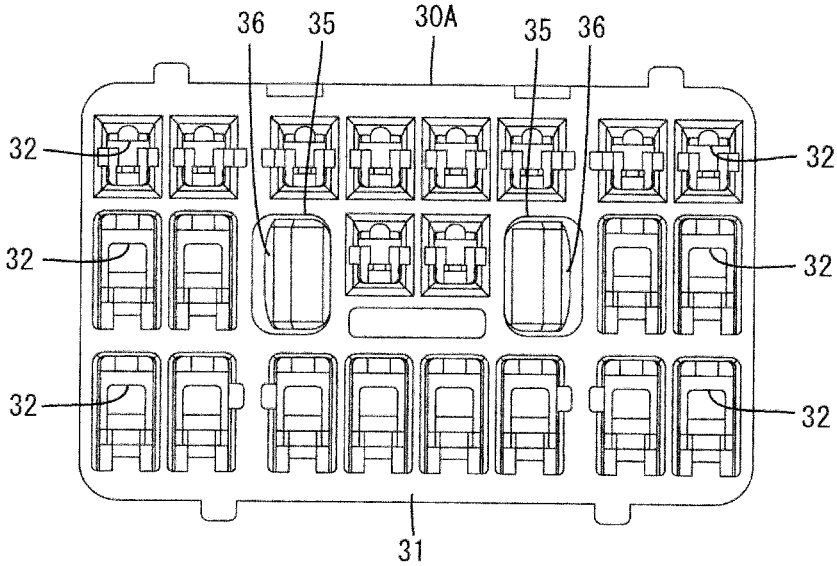
FIG. 9 is a rear view of the first inner housing.
Figure 10:
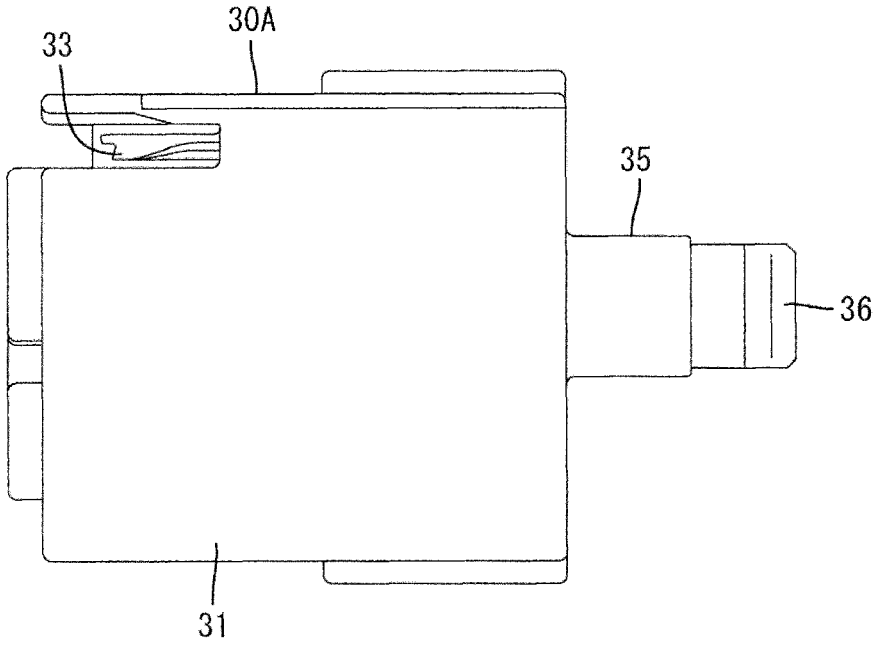
FIG. 10 is a side view of the first inner housing.

As shown in FIGS. 8 to 10, the first inner housing 30A includes a (particularly substantially block-shaped) housing main body 31. As shown in FIG. 3, the housing main body 31 is formed with one or more, particularly a plurality of cavities 32 extending in forward and backward directions. A resiliently deformable locking lance 33 is formed at an inner wall of each cavity 32 to substantially project backward. A first terminal fitting 110A at least partly is inserted into each cavity 32 particularly substantially from front.

The first terminal fitting 110A is formed such as by bending an electrically conductive (particularly metal) plate and connected (particularly crimped and connected) to an end portion of a wire 120 as shown in FIG. 3. When being properly inserted into the cavity 32, the first terminal fitting 110A is resiliently locked by the locking lance 33, thereby being retained in the cavity 32. Note that the first terminal fittings 110A particularly come in a plurality of types with different sizes and one or more second terminal fittings 110B to be at least partly accommodated into the second inner housing 30B particularly are identically shaped to the first terminal fittings 110A and/or particularly come in a plurality of types similarly to the first terminal fittings 110A.

As shown in FIG. 8, the front surface of the housing main body 31 is recessed to form one or more, particularly a pair of rib receiving portions 34 particularly at least partly between adjacent cavities 32. In a state where the first inner housing 30A at least partly is fitted in the first fitting recess 12, the guide rib(s) 16 is/are positioned and at least partly inserted into the respective rib receiving portion(s) 34. Further, as shown in FIGS. 9 and 10, one or more, particularly a pair of lock protrusions 35 are formed to project backward from (particularly the rear surface, right side of FIG. 10, of) the housing main body 31. The (particularly both) lock protrusion(s) 35 is/are arranged at respective position(s) coaxial with the (both) rib receiving portion(s) 34 in forward and backward directions. One or more lock claws 36 are formed to project outward from (particularly tip parts of) the (both) lock protrusion(s) 35. When the first inner housing 30A is assembled with the first outer housing 50, the (particularly both) lock protrusion(s) 35 penetrate(s) through a resilient or rubber plug 140 to be described later in a fluid-tight manner and the lock claw(s) 36 of the (both) lock protrusion(s) 35 resiliently lock(s) a later-described base wall 51 of the second outer housing 70, with the result that the first inner housing 30A is inseparably coupled to the first outer housing 50.

Further, as shown in FIG. 3, at least one retainer 130 is mounted on (particularly the rear surface of) the housing main body 31. The retainer 130 is likewise made e.g. of synthetic resin and particularly includes a plate-like front wall 131 and a (particularly substantially tubular) peripheral wall 132 projecting forward from (particularly the outer edge of) the front wall 131. The front wall 131 particularly is arranged to at least partly cover the front surface of the housing main body 31 when the retainer 130 is mounted and, as shown in FIG. 2, formed with one or more, particularly a plurality of through holes 134, through which the first end portion(s) 91 of the intermediate terminal(s) 90 penetrate(s), at one or more positions facing the respective cavity/cavities 32. In this case, the first end portion(s) 91 of the intermediate terminal(s) 90 particularly substantially is/are guided into the cavity/cavities 32 by the through hole(s) 134 and electrically connected to the first terminal fitting(s) 110A at least partly inserted in the cavity/cavities 32.

As shown in FIG. 3, on (particularly the rear surface of) the front wall 131, one or more, particularly a plurality of retaining portions 135 are formed to project forward adjacent to the one or more through holes 134, particularly substantially from edge parts of the respective through holes 134. When the retainer 130 is properly inserted onto the housing main body 31, the respective retaining portion(s) 135 at least partly enter(s) deformation space(s) for the locking lance(s) 33, whereby resilient deformation(s) of the locking lance(s) 33 is/are prevented and reliability in retaining the first terminal fitting(s) 110A is enhanced.

The peripheral wall 132 particularly is arranged to at least partly cover the lateral (upper and/or lower) surface(s) and/or the lateral (left and/or right) surface(s) (opposite widthwise end surfaces) of a front part of the housing main body 31 when the retainer 130 is mounted. Out of the outer surfaces of the peripheral wall 132, a surface exposed below or laterally of the housing main body 31 particularly serves as a confirmation surface 133 which can be visually confirmed through a later-described escaping portion 61 of the first outer housing 50. Note that a retainer 130 particularly substantially having the same shape as described above is also mounted onto the second inner housing 30B.

As shown in FIG. 3, the resilient or rubber plug 140 particularly substantially in the form of a mat extending in the vertical direction is arranged in contact with the front surface of the housing main body 31. The resilient or rubber plug 140 is made of a resilient material, particularly of rubber such as silicon rubber and one or more, particularly a plurality of seal holes 141 penetrate therethrough. One or more, particularly a plurality of inner lips 142 are (particularly substantially circumferentially) formed on the inner peripheral surface of the (particularly each) seal hole 141. When the first terminal fitting 110A is inserted into each cavity 32, the wire 120 extending from the first terminal fitting 110A is inserted into the seal hole 141 and the respective inner lip(s) 142 is/are resiliently held in close contact with the outer peripheral surface of the wire 120, thereby providing sealing around the wire 120. Further, one or more, particularly a plurality of outer lips 143 are (particularly substantially circumferentially) formed on the outer surface of the resilient or rubber plug 140. When the first inner housing 30A is properly inserted into the first fitting recess 12, the respective outer lip(s) 143 is/are resiliently held in close contact with the inner peripheral surface of the first fitting recess 12, thereby sealing the interior of the first fitting recess 12. Note that a resilient or rubber plug 140 particularly substantially having the same shape as described above is also mounted into the second inner housing 30B.

Figure 12:
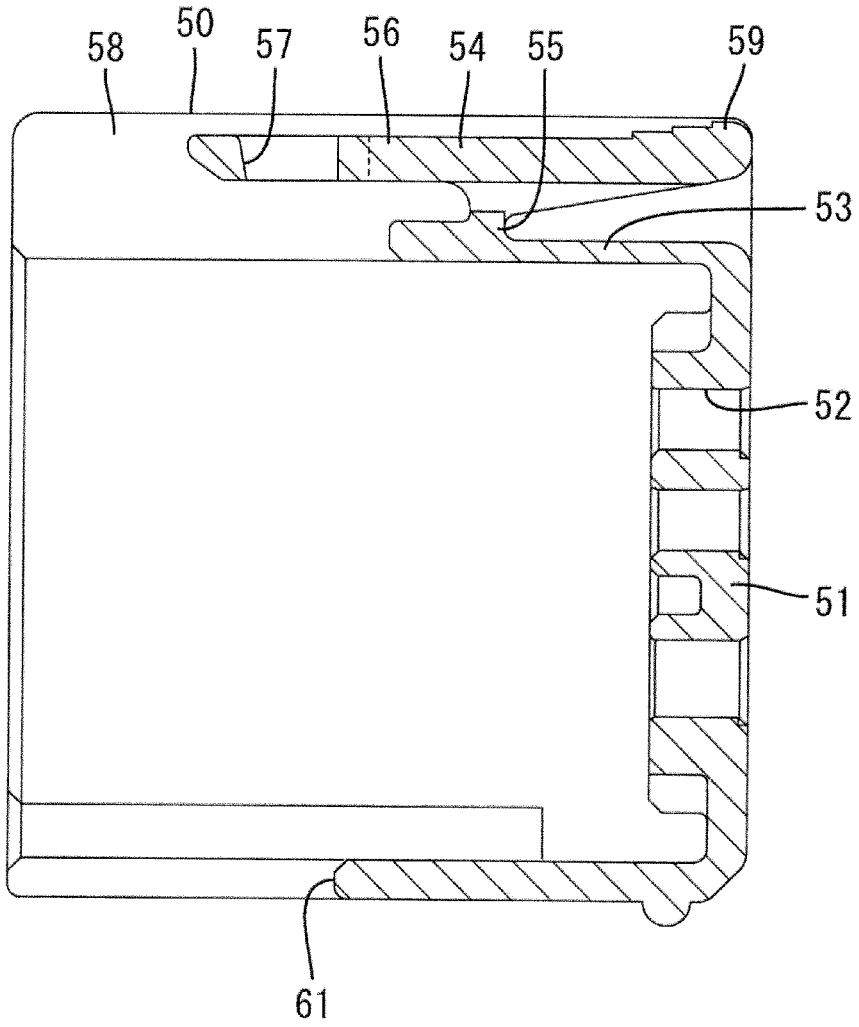
FIG. 12 is a section showing a lock arm of the first outer housing.

Next, the first outer housing 50 is described. The first outer housing 50 is made e.g. of synthetic resin and, as shown in FIG. 12, includes the base wall 51 (particularly substantially in the form of a vertical wall) and the tubular outer peripheral wall 53 projecting backward from the outer edge of the base wall 51. When the first outer housing 50 is externally fitted onto the first fitting recess 12, the front surface of the base wall 51 particularly substantially is arranged in contact with the resilient or rubber plug 140 and the resilient or rubber plug 140 is resiliently sandwiched between the housing main body 31 and the base wall 51.

The base wall 51 includes one or more, particularly a plurality of insertion holes 52 at one or more positions corresponding or facing the respective seal hole(s) 141 of the resilient or rubber plug 140. The respective insertion hole(s) 52 is/are arranged to substantially coaxially communicate with the respective cavity/cavities 32 and the respective seal hole(s) 141 in forward and backward directions. When the first terminal fitting 110A is properly inserted into the (particularly each) cavity 32 as shown in FIG. 3, the wire 120 extending from the first terminal fitting 110A is loosely inserted into the insertion hole 52. Further, the lock claw(s) 36 of the aforementioned lock protrusion(s) 35 of the first inner housing 30A particularly is/are resiliently hooked and engaged with the front surface side of the base wall 51.

Figure 11:
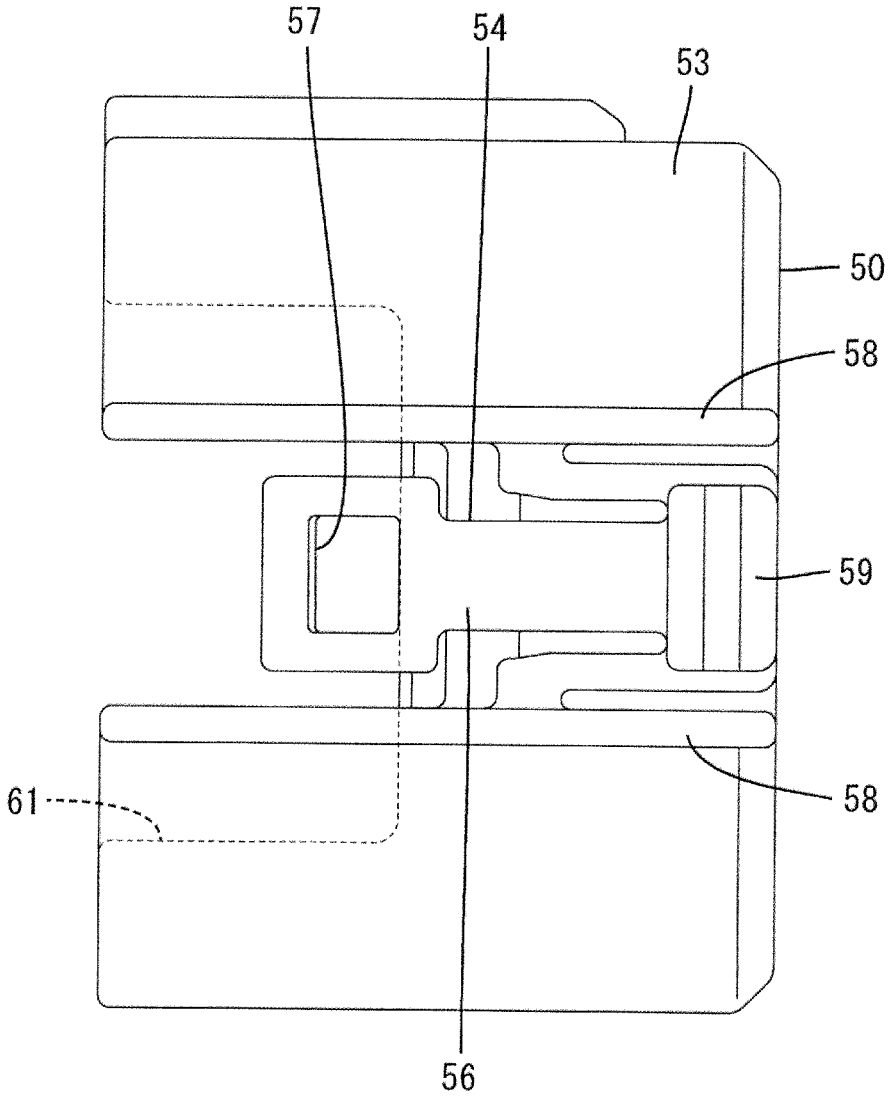
FIG. 11 is a plan view of a first outer housing.

As shown in FIG. 11, a lock arm 54 (first holding means) is formed in an intermediate position (particularly substantially in the widthwise center) of a lateral (particularly upper) part of the outer peripheral wall 53. As shown in FIG. 12, the lock arm 54 particularly is composed of or comprises a leg portion 55 substantially projecting outward or upward from (particularly a rear end side of a part of) the upper part of the outer peripheral wall 53 substantially projecting backward from the outer or upper end of the base wall 51 and an arm main body 56 substantially extending in (particularly both) forward and backward directions from the outer or upper end of the leg portion 55, and particularly resiliently deformable like a seesaw with the leg portion 55 as a supporting point. As shown in FIG. 11, a rear end part of the arm main body 56 particularly substantially is in the form of a (particularly substantially rectangular) frame and a lock hole 57 is formed inside. Further, one or more, particularly a pair of protecting portions 58 are formed to project or stand up at (particularly substantially opposite widthwise sides of) the lock arm 54 on the outer or upper part of the outer peripheral wall 53. When the first outer housing 50 is externally fitted to proper depth onto the first fitting recess 12 as shown in FIG. 2, the lock portion 17 at least partly is resiliently fitted into the lock hole 57, whereby the first outer housing 50 particularly is inseparably (fitted state) held on the first fitting recess 12 together with the first inner housing 30A. Note that an unlocking portion 59 to be pressed in releasing the fitted state in the first fitting recess 12 is raised on a front end part of the arm main body 56.

Figure 13:
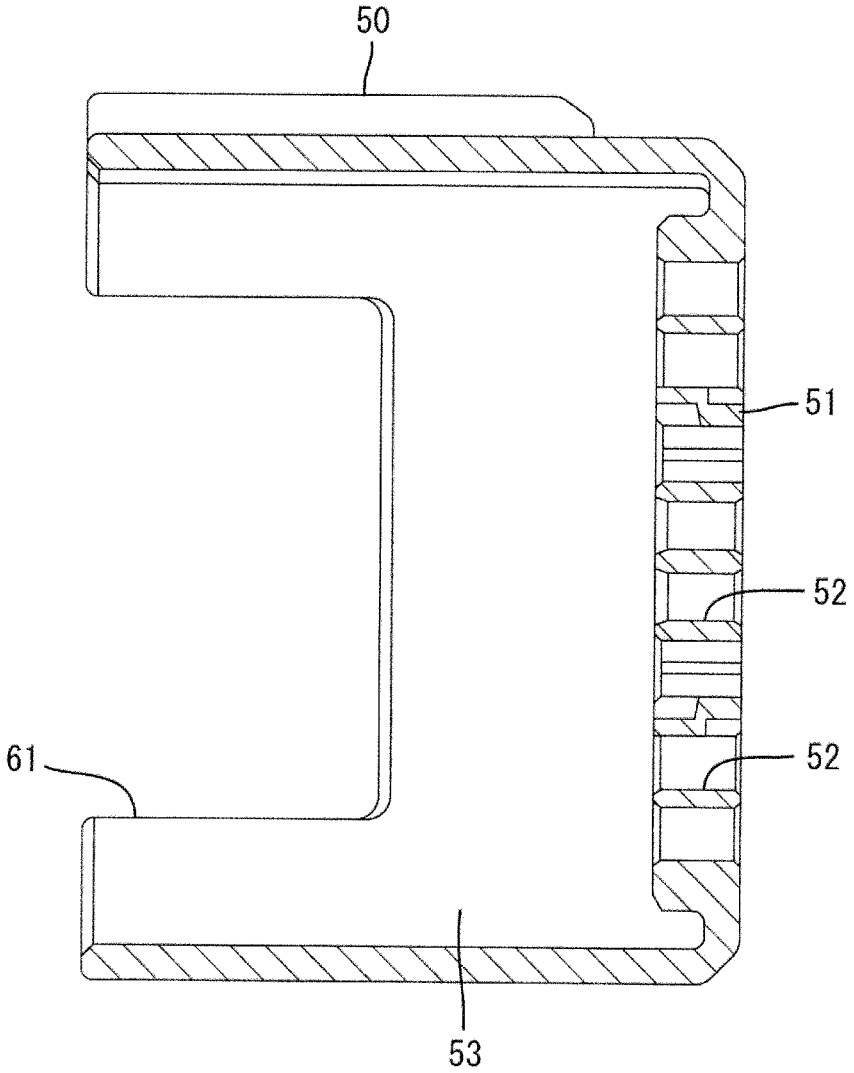
FIG. 13 is a section showing a lower part of an outer peripheral wall of the first outer housing.

Further, as shown in FIG. 13, the rear end of the lower part of the outer peripheral wall 53 is recessed to form the escaping portion 61. The escaping portion 61 is a large and particularly substantially rectangular cut formed in a front part (particularly a substantially front half) except opposite widthwise end parts of the outer peripheral wall 53. When the first outer housing 50 is externally fitted onto the first fitting recess 12, an outer or upper end part of the mounting portion 21 is allowed to escape by at least partly entering the escaping portion 61. Further, in a state where the first inner housing 30A is assembled with the first outer housing 50 and the retainer 130 is mounted onto the first inner housing 30A as shown in FIG. 3, the particularly substantially entire confirmation surface 133 of the retainer 130 can be seen though the escaping portion 61.

Figure 1:
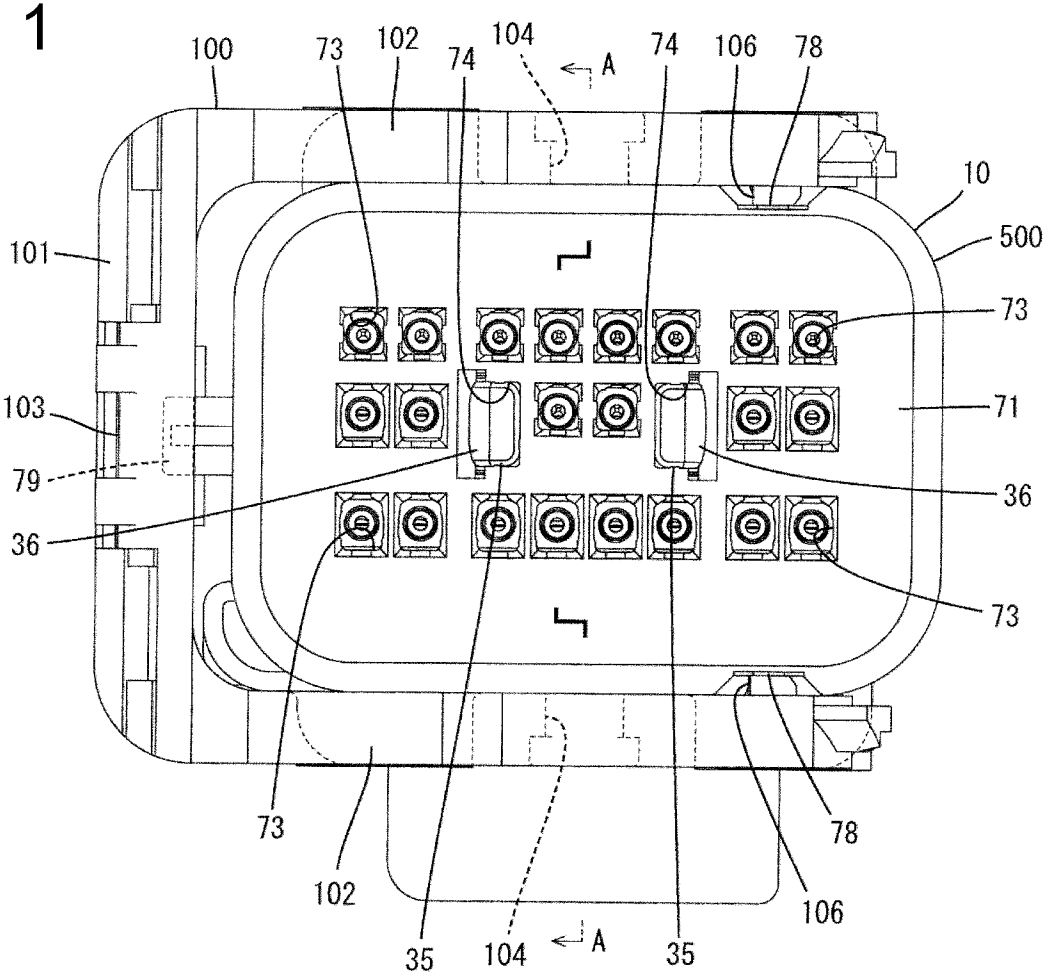
FIG. 1 is a front view of a connector according to an embodiment of the present invention.
Figure 4:
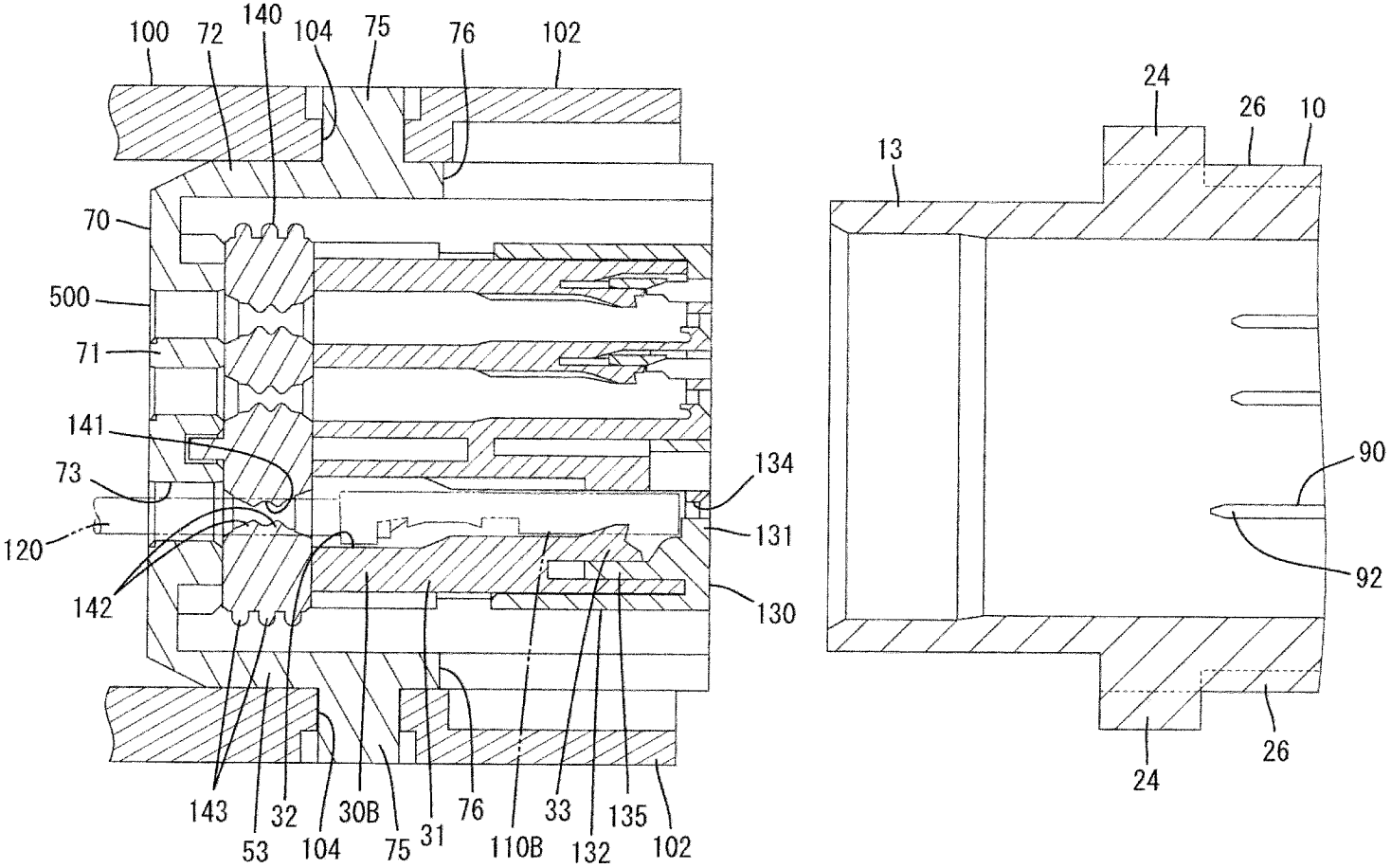
FIG. 4 is an exploded section of a second housing and a second fitting recess.
Figure 14:
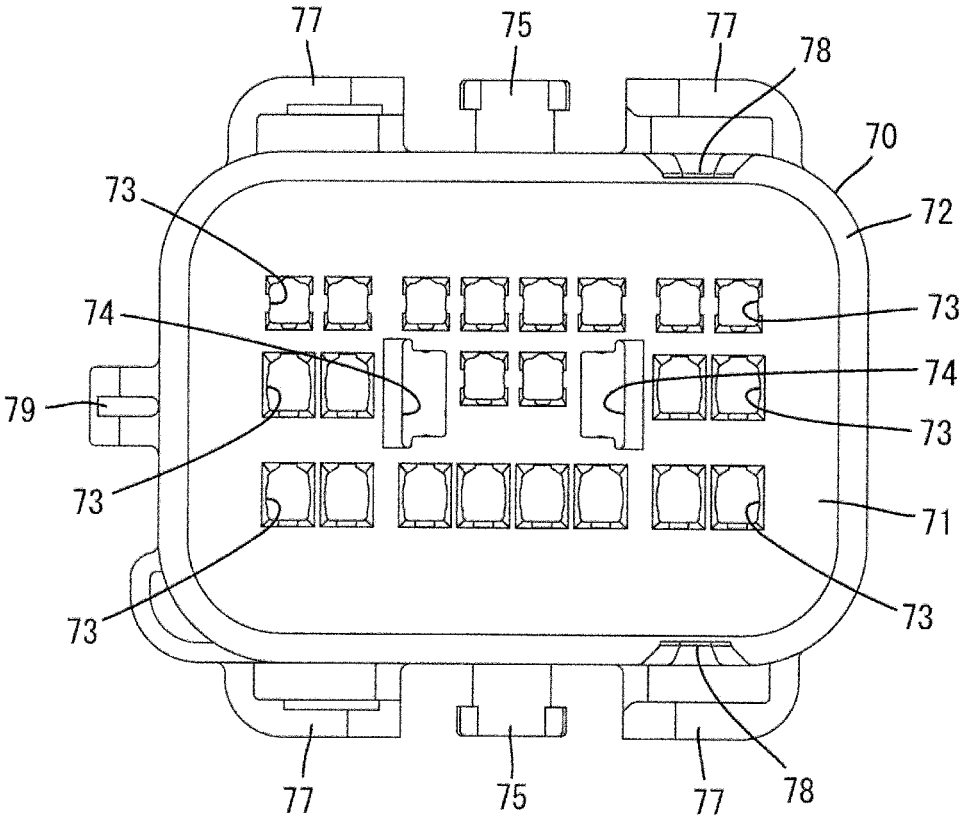
FIG. 14 is a rear view of a second outer housing.

Next, the second outer housing 70 is described. The second outer housing 70 is made e.g. of synthetic resin and, as shown in FIGS. 4 and 14, includes a base wall portion 71 particularly substantially in the form of a vertical wall and a (particularly substantially tubular) outer peripheral wall portion 72 projecting forward from (particularly the outer edge of) the base wall portion 71. The base wall portion 71 particularly is identically shaped to the base wall 51 and arranged in contact with the resilient or rubber plug 140 and includes insertion hole(s) 73, into which the wire(s) 120 is/are loosely insertable, at position(s) substantially facing the respective seal hole(s) 141. Further, the base wall portion 71 is formed with one or more, particularly a pair of through holes 74 (particularly spaced apart in the width direction) as shown in FIG. 14 and the lock claw(s) 36 on the lock protrusion(s) 35 of the second inner housing 30B is/are resiliently hooked and engaged with the hole edge(s) of the through hole(s) 74 on the front surface side of the base wall portion 71 as shown in FIG. 1. Note that, although not shown, the base wall 51 is also formed with similar through hole(s).

Figure 15:
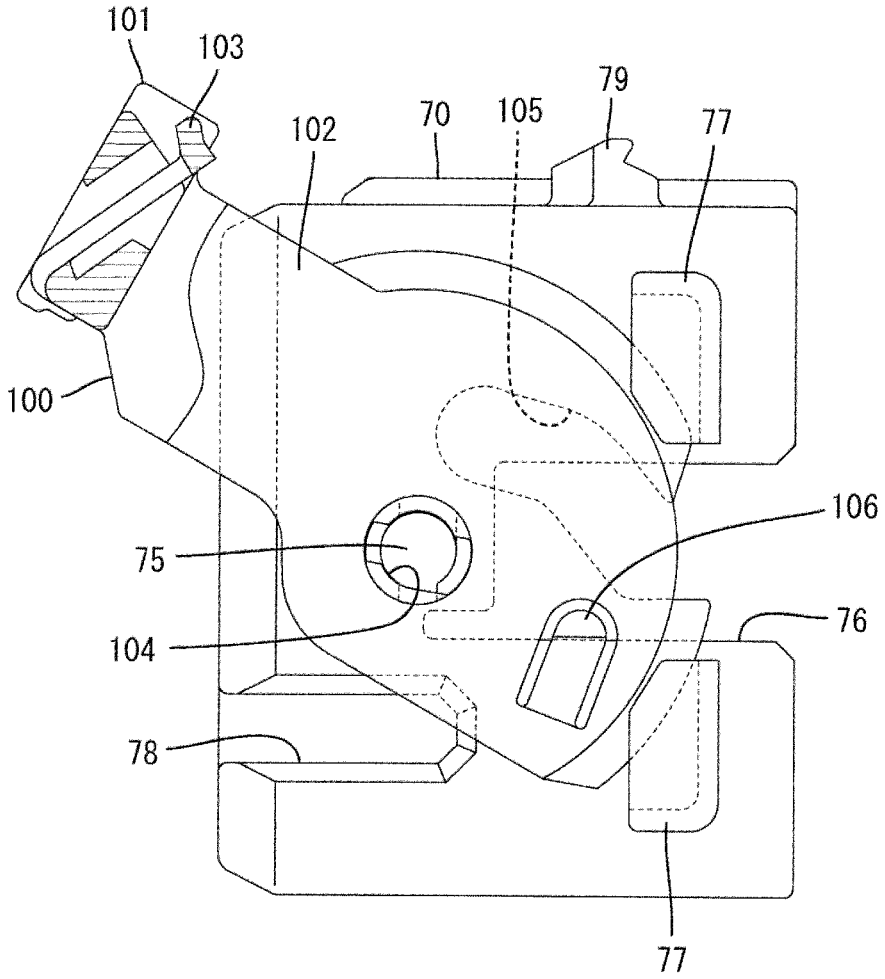
FIG. 15 is a plan view of the second outer housing on which a lever is mounted at an initial position.

As shown in FIG. 14, one or more, particularly a pair of support shafts 75 project in an intermediate part (particularly in widthwise central part(s) of upper and/or lower part(s)) of the outer peripheral wall portion 72. The support shaft(s) 75 particularly substantially have a cylindrical shape and can support the lever 100 as shown in FIG. 4. Further, the intermediate part(s) (particularly the widthwise central parts of the upper and/or lower part(s)) of the outer peripheral wall portion 72 is/are cut to form introducing one or more grooves 76 extending forward from the rear end as shown in FIGS. 4 and 15. As shown in FIG. 14, one or more, particularly a pair of spread preventing walls 77 are formed adjacent to the introducing groove 76, particularly at substantially opposite widthwise sides of the introducing groove 76 on each of the upper and lower parts of the outer peripheral wall portion 72. The respective spread preventing wall(s) 77 particularly has/have a bag shape with an open front side and function to prevent the spread of later-described arm portion(s) 102 of the lever 100 by allowing the at least partial entrance of the arm portion(s) 102 thereinto. When the second outer housing 70 on which the lever 100 is mounted is externally fitted onto the second fitting recess 13, the cam portion(s) 24 of the second fitting recess 13 is/are introduced into the introducing groove(s) 76 and enter(s) the entrance(s) of later-described cam groove(s) 105 of the lever 100. Note that the support shaft(s) 75 particularly is/are arranged immediately behind the introducing groove(s) 76.

As shown in FIGS. 14 and 15, one widthwise side of (particularly each of) the upper and/or lower part(s) of the outer peripheral wall portion 72 is recessed to form an escaping recess 78 having a bottom on an inner side and substantially extending forward from the rear end. The escaping recess(es) 78 allow(s) the resilient locking portion(s) 106 of the lever 100 to escape. Further, a lever lock receiving portion 79 projects on the outer surface of the other widthwise side of the outer peripheral wall portion 72.

The lever 100 is made e.g. of synthetic resin and, as shown in FIG. 1, includes an operating portion 101 (particularly substantially extending along the vertical direction) and one or more, particularly a pair of arm portions 102 projecting from the operating portion 101, particularly projecting substantially in parallel to each other from both upper and lower ends of the operating portion 101 and is gate-shaped as a whole. As shown in FIG. 15, the operating portion 101 is formed with a resiliently deformable lever lock portion 103. The (particularly each) arm portion 102 is formed with a penetrating bearing portion 104 for receiving the support shaft 75 and the cam groove 105 that is open on the outer peripheral edge. Further, the (particularly each) arm portion 102 is cut to form the resiliently deformable resilient locking portion 106.

The lever 100 is mounted (particularly to straddle) on the second outer housing 70 from behind and displaceable (particularly rotatable or pivotable) between an initial position and a connection position particularly about the support shafts 75 in a state where the support shaft(s) 75 is/are fitted in the bearing portion(s) 104. As shown in FIG. 15, at the initial position, tip part(s) of the resilient locking portion(s) 106 resiliently lock(s) groove edge(s) of the introducing groove(s) 76, thereby preventing the movement (particularly the rotation) of the lever 100 to the connection position. In the process of externally fitting the second outer housing 70 onto the second fitting recess 13, the releasing rib(s) 27 at least partly enter(s) the introducing groove(s) 76 to interfere with the resilient locking portion(s) 106, thereby releasing a locking state of the resilient locking portion(s) 106 to permit the movement (rotation) of the lever 100 toward or to the connection position. As shown in FIG. 1, at the connection position, the tip part(s) of the resilient locking portion(s) 106 at least partly enter(s) the escaping recess(es) 78, whereby the resilient locking portion(s) 106 is/are released from a resiliently deformed state and return to or toward a substantially natural state, and the lever lock portion 103 resiliently locks the lever lock receiving portion 79 to hold or position the lever 100 at the connection position. Further, when the lever 100 is moved (particularly rotated or pivoted), the outer peripheral edge(s) of the (both) arm portion(s) 102 particularly is/are kept inserted at the inner side(s) of the spread preventing wall(s) 77, whereby the (particularly both) arm portion(s) 102 particularly is/are prevented from being deflected (particularly spreading outwardly away from each other) upon being subjected to the connecting force.

The structure of the connector according to this embodiment is as described above. Next, an assembling procedure, functions and effects of the connector are described.

First, as shown in FIG. 5, the intermediate terminal(s) 90 is/are at least partly inserted (particularly press-fitted) into the respective mounting hole(s) 14 of the partition wall 11 of the intermediate housing 10 to be mounted and particularly held or positioned.

The first and second inner housings 30A, 30B are respectively coupled to the first and second outer housings 50, 70 via the lock protrusion(s) 35 in a state where the rubber plug(s) 140 is/are sandwiched between the first inner housing 30A and the base wall 51 and/or between the second inner housing 30B and the base wall portion 71. Further, the lever 100 is mounted to or on the second outer housing 70 particularly by fitting the one or more bearing portions 104 of the lever 100 onto the one or more support shafts 75 of the second outer housing 70. In this case, the lever 100 is positioned or kept at the initial position particularly by the engagement of the resilient locking portion(s) 106 with the groove edge(s) of the introducing groove(s) 76. Note that, in the following description, the first inner housing 30A and the first outer housing 50 in a coupled state are called a first housing 400 and the second inner housing 30B, the second outer housing 70 and the lever 100 in a coupled state are called a second housing 500.

Subsequently, the first and second terminal fittings 110A, 110B are inserted into the respective cavities 32 of the housing main bodies 31 of the first and second inner housings 30A, 30B and the retainers 130 particularly are mounted to proper depth onto the housing main bodies 31, whereby the first and second terminal fittings 110A, 110B are held and particularly retained in the cavities 32.

In this case, as shown in FIG. 3, the confirmation surface 133 of the retainer 130 mounted onto the first inner housing 30A particularly can be visually confirmed through the escaping portion 61 of the first outer housing 50 laterally or from below. Specifically, since the front end of the peripheral wall 132 of the retainer 130 particularly is located behind the rear end of the escaping portion 61, the substantially entire confirmation surface 133 including the front end of the peripheral wall 132 is visually confirmed. Thus, if it is forgotten to mount the retainer 130, the confirmation surface 133 cannot be (particularly completely) seen through the escaping portion 61. Further, if the retainer 130 is not mounted to proper depth, the position of the confirmation surface 133 seen through the escaping portion 61 has not reached a specified (predetermined or predeterminable) position. In this way, it can be known that the retainer 130 has not reached a proper insertion position. In that case, the retainer 130 is pushed again to the proper insertion position.

Subsequently, the first housing 400 at least partly is fitted to the first fitting recess 12 of the intermediate housing 10 particularly substantially from front. Then, the housing main body 31 of the first inner housing 30A at least partly is fitted into the first fitting recess 12 and the outer peripheral wall of the first outer housing 50 is (particularly substantially externally) fitted to or onto the first fitting recess 12 (see FIG. 2). In the fitting process, the first housing 400 is pushed to the first fitting recess 12, whereby the arm main body 56 of the lock arm 54 interferes with the lock portion 17 of the first fitting recess 12 and is (particularly pivotally) displaced with the leg portion 55 as a supporting point. When the first housing 400 is properly fitted, the arm main body 56 resiliently at least partly returns and the lock portion 17 at least partly is fitted into the lock hole 57, whereby the first housing 400 is inseparably held on the first fitting recess 12.

When the first housing 400 is properly fitted to the first fitting recess 12, the first end portion(s) 91 of the intermediate terminal(s) 90 is/are inserted into the cavity/cavities 32 through the through hole(s) 134 of the retainer 130 to be electrically connected to the first terminal fitting(s) 110A. Further, the upper end part of the mounting portion 21 particularly is inserted into the escaping portion 61 of the first outer housing 50 through the entrance recess 23 to avoid the interference of the first outer housing 50 and the mounting portion 21. Further, the respective outer lip(s) 143 of the rubber plug 140 is/are resiliently held in close contact with the inner surface of the first fitting recess 12 to seal the interior of the first fitting recess 12.

On the other hand, the second housing 500 is inserted or fitted to the second fitting recess 13 of the intermediate housing 10 particularly substantially from behind. Then, the housing main body 31 of the second inner housing 30B at least partly is fitted into the second fitting recess 13 and the outer peripheral wall portion 72 of the second outer housing 50 is (particularly substantially externally) fitted to or onto the second fitting recess 13 (see FIG. 2). When the second outer housing 70 is lightly fitted onto the second fitting recess 13, the cam portion(s) 24 enter(s) the entrance(s) of the cam groove(s) 105 of the lever 100 and the locking state of the resilient locking portion(s) 106 of the lever 100 is released by the one or more releasing ribs 27. In that state, the lever 100 is displaced (particularly rotated or pivoted) toward the connection position particularly by gripping or operating the operating portion 101. Then, the cam portion(s) 24 slide(s) on groove surface(s) of the cam groove(s) 105 to display a cam action between the lever 100 and the second housing 500, and the second housing 500 is fitted to the second fitting recess 13 with a small operating force. When the lever 100 substantially reaches the connection position in this way, the lever lock portion 103 resiliently locks the lever lock receiving portion 79, the lever 100 is unmovably (particularly unrotatably) held on the first fitting recess 13 and, consequently, the second housing 500 is inseparably held on the second fitting recess 13.

When the first housing 400 is properly fitted to the second fitting recess 13, the second end portion(s) 92 of the intermediate terminal(s) 90 is/are inserted into the cavity/cavities 32 through the through hole(s) 134 of the retainer 130 to be electrically connected to the second terminal fitting(s) 110B. Further, the respective outer lip(s) 143 of the resilient or rubber plug 140 is/are resiliently held in close contact with the inner surface of the second fitting recess 13 to seal the interior of the second fitting recess 13.

As described above, according to this embodiment, the first housing 400 to be fitted to the first fitting recess 12 and the second housing 500 to be fitted to the second fitting recess 13 cannot have the same shape as a whole due to a shape difference between the lever 100 and the lock arm 54. According to this embodiment, the first outer housing 50 to be held on the first fitting recess 12 by the lock arm 54 and the second outer housing 70 to be held on the second fitting recess 13 by the lever 100 are shaped differently from each other. However, since the first and second inner housings 30A, 30B are identically shaped, they can be commonly or exchangeably used and cost can be suppressed by that much.

Further, on the side of the second fitting recess 13, the connecting operation can be performed with a small operating force by the cam action of the lever 100. In this case, if the first housing 400 also includes a lever 100 to share parts, cost increases. However, according to this configuration, the lever 100 needs not be provided on the first housing 400 which can be manually connected, a cost increase can be suppressed to a minimum necessary level.

Further, since the first outer housing 50 particularly is provided with the escaping portion 61 for avoiding interference with the mounting portion 21 and this escaping portion 61 particularly also has a detecting function for the confirmation of the inserted state of the retainer 130, the configuration of the first housing 400 is simplified.

Furthermore, since the front end of the peripheral wall 132 of the retainer 130 particularly can be visually confirmed through the escaping portion 61 of the first outer housing 50, the inserted state of the retainer 130 can be accurately known by confirming the front end position of the peripheral wall 132.

The invention is not limited to the above described and illustrated embodiment. For example, the following embodiments are also included in the technical scope of the present invention.

The first and second fitting recesses may be open in directions intersecting with each other.

The second holding means may be a slide-type lever which displays a cam action by being slid in a direction particularly intersecting with the connecting direction relative to the housing main body.

The first holding means is composed of a lever similarly to the second holding means, but may have a shape and/or locking strength different from the lever of the second holding means.

The second holding means is composed of a lock arm similarly to the first holding means, but may have a shape and/or locking strength different from the lock arm of the first holding means.

The intermediate terminals may be mounted on the partition wall by insert molding.

The resilient or rubber plug 140 may be formed by a gelatinous or elastic material through which the respective terminal fitting(s) 110A is/are pierced. The gelatinous or elastic material may be a gel or elastic or rubbery material containing three dimensional cross-linked molecular formations or behave as if it contained such molecular formations (geloids). One example of a gel that can be used is silicone gel or resin. Another suitable gel comprises a block copolymer having relatively hard blocks (e.g. hydrogenated rubber blocks) examples of such copolymers including styrene-diene block copolymers (linear or radial) for example styrene-butadiene or styrene-isoprene diblock or triblock copolymers, or styrene-ethylene-butylene-styrenes triblock copolymers. The gel may be formed from a single liquid material which becomes a gel when subjected e.g. to radiation or chemicals; the gel may be formed from two components which become a gel when mixed; or the gel may be a composition which is a gel at working temperature, e.g. room temperature. Additionally or alternatively a gel material as disclosed in U.S. Pat. No. 4,875,870 may be used, which is included herein by reference.

What is claimed is:

1. A connector, comprising:

an intermediate housing including a first fitting recess and a second fitting recess;

a first inner housing which is to be fit into the first fitting recess and into which at least one first terminal fitting is to be mounted;

a first outer housing separate from the first inner housing, fit to the first fitting recess, coupled to the first inner housing and held in a state fit on the first fitting recess by a first holding means;

a second inner housing which is to be fit into the second fitting recess and into which at least one second terminal fitting is to be mounted; and a second outer housing separate from the second inner housing, fit to the second fitting recess coupled to the second inner housing and held in a state fit on the second fitting recess by a second holding means different from the first holding means;

wherein:

the first and second outer housings are shaped differently from each other at least due to a difference between the first and second holding means; and the first and second inner housings are identically shaped.

2. The connector of claim 1, wherein the intermediate housing includes at least one partition wall through which at least one intermediate terminal penetrates to be mounted, wherein a first end portion and a second end portion of the intermediate terminal are located at opposite sides of the partition wall in the first fitting recess and the second fitting recess to be connected to the first terminal fitting and the second terminal fitting, respectively.

3. The connector of claim 2, wherein the partition wall comprises at least one projecting plate projecting into the second fitting recess.

4. The connector of claim 1, wherein the first outer housing is externally fit onto the first fitting recess, coupled to the first inner housing to at least partly surround the first inner housing and wherein the second outer housing is externally fit onto the second fitting recess, coupled to the second inner housing to at least partly surround the second inner housing.

5. The connector of claim 1, wherein the first holding means comprises a lock arm for resiliently locking a lock portion provided on or at the first fitting recess at the time of proper connection.

6. The connector of claim 1, wherein the second holding means comprises a lever that displays a cam action between the lever and the intermediate housing to proceed with a connecting operation by being displaced relative to the second fitting recess in a state where the second holding means is engaged with a cam provided on the second fitting recess.

7. The connector of claim 1, wherein at least one releasing rib is formed on the second fitting recess to release a locking state of the second holding means.

8. The connector of claim 1, wherein at least one shake preventing protrusion is formed on the second fitting recess to come contact the second outer housing externally fit on the second fitting recess.

* * * * *